US008757137B2

(12) United States Patent
Cadima

(10) Patent No.: US 8,757,137 B2
(45) Date of Patent: Jun. 24, 2014

(54) MULTI-RINGED BURNER WITH SPILL CONTAINMENT

(75) Inventor: Paul Bryan Cadima, Prospect, KY (US)

(73) Assignee: General Electric Company, Schenectady, NY (US)

( * ) Notice: Subject to any disclaimer, the term of this patent is extended or adjusted under 35 U.S.C. 154(b) by 48 days.

(21) Appl. No.: 13/412,234

(22) Filed: Mar. 5, 2012

(65) Prior Publication Data

US 2013/0228162 A1 Sep. 5, 2013

(51) Int. Cl.
*F24C 3/00* (2006.01)

(52) U.S. Cl.
USPC ..... 126/39 E; 431/144; 431/254; 431/354

(58) Field of Classification Search
USPC ..... 126/39 E; 431/144, 214 A, 254, 354
See application file for complete search history.

(56) References Cited

U.S. PATENT DOCUMENTS

2004/0234915 A1* 11/2004 Koch et al. ..... 431/278
2007/0154858 A1* 7/2007 Cadima ..... 431/354
2010/0206293 A1* 8/2010 Padgett et al. ..... 126/39 E
2010/0279238 A1 11/2010 Harneit

* cited by examiner

*Primary Examiner* — Kenneth Rinehart
*Assistant Examiner* — Gajanan M Prabhu
(74) *Attorney, Agent, or Firm* — Global Patent Organization; Douglas D. Zhang

(57) ABSTRACT

A gas burner assembly is provided for a cooking appliance including a cooktop surface. The gas burner assembly comprises an outer gas burner comprising an outer burner body, the outer gas burner configured to provide an outer cooking flame; and an inner gas burner comprising an inner burner body, the inner gas burner configured to provide an inner cooking flame, wherein secondary air supplied to the inner gas burner flows through one or more openings through the cooktop surface, wherein one or more channels direct spills beneath the outer gas burner onto the cooktop surface.

11 Claims, 7 Drawing Sheets

MULTI-RINGED BURNER WITH SPILL CONTAINMENT

BACKGROUND OF THE INVENTION

The subject matter disclosed herein relates to gas appliances, such as gas ranges, and more particularly, to multi-ringed burners for use in such gas appliances.

For gas burners that are used as surface heating units in cooking appliances, such as ranges and cooktops, a sealed burner mounting is generally desirable. In a sealed burner mounting, there are no gaps between the burner assembly and the cooktop surface the burner assembly mounts on to allow spills to get beneath the cooktop surface. Multi-ringed gas burner assemblies are also desirable for improved performance. Multi-ringed gas burner assemblies typically include at least an inner gas burner and an outer gas burner for collectively producing a plurality of rings of flame to heat a utensil supported thereon. In a sealed multi-ringed burner, there are no gaps around the burner to allow spills or air to get inside the cooktop. Sealed multi-ringed burners thus need a method to introduce secondary air into the inner ring of flame for proper combustion.

A number of techniques exist for introducing secondary air into the center ring of flame in a multi-ringed burner. For example, in a floating burner head design, the outer burner head is spaced up above the maintop to allow air to travel beneath it. The floating burner head design, however, has an unsightly gap between the burner and the maintop, and exhibits a taller burner profile. In another design approach, vents in the maintop feed air to the center of the burner from beneath the maintop. The vented design approach, however, allows spills to travel through these vents, beneath the maintop, which are not possible to clean without disassembling the maintop unit. In yet another design approach, slots are introduced through the sides of the outer burner head to feed air to the center. The slotted design approach, however, requires complex tooling with retractable sections, is difficult to clean within the slots, and exhibits a taller burner profile.

Thus, a need remains for an improved multi-ring burner design. Yet another need exists for an improved multi-ringed burner with improved aesthetics that can be more easily cleaned and provides a more compact design than existing design approaches.

BRIEF DESCRIPTION OF THE INVENTION

As described herein, the exemplary embodiments of the present invention overcome one or more disadvantages known in the art.

One aspect of the present invention relates to a gas burner assembly for a cooking appliance including a cooktop surface, the gas burner assembly comprising an outer gas burner comprising an outer burner body, the outer gas burner configured to provide an outer cooking flame; and an inner gas burner comprising an inner burner body, the inner gas burner configured to provide an inner cooking flame, wherein secondary air supplied to the inner gas burner flows through one or more openings through the cooktop surface, wherein one or more channels comprise a spill path beneath the outer burner onto the cooktop surface.

Another aspect of the present invention relates to a gas cooking appliance comprising a cooktop surface, and a gas burner assembly. The gas burner assembly comprises an outer gas burner comprising an outer burner body, the outer gas burner configured to provide an outer cooking flame; and an inner gas burner comprising an inner burner body, the inner gas burner configured to provide an inner cooking flame, wherein secondary air supplied to the inner gas burner flows through one or more openings through the cooktop surface, wherein one or more channels comprise a spill path beneath the outer burner onto the cooktop surface.

Advantageously, illustrative embodiments of the present invention provide an improved multi-ring burner that directs the secondary air flow path to the center burner from beneath the cooktop through openings in the bottom of the burner shielded from view by an outer burner head. In addition, spills are channeled around the openings to the exterior of the burner above the maintop.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

One or more illustrative embodiments of the invention will be described below in the context of an oven appliance. However, it is to be understood that embodiments of the invention are not intended to be limited to use with any particular gas appliance. Rather, embodiments of the invention may be applied to and deployed in any other suitable environment in which it would be desirable to operate a multi-ring burner.

As illustratively used herein, the term "appliance" is intended to refer to a device or equipment designed to perform one or more specific functions. This may include, but is not limited to, equipment for consumer use, e.g., a gas range on a freestanding oven. This may include, but is not limited to, any equipment that is useable in household or commercial environments.

While the methods and apparatus are herein described in the context of a gas-fired cooktop, as set forth more fully below, it is contemplated that the herein described methods and apparatus may find utility in other applications, including, but not limited to, gas heater devices, gas ovens, gas kilns, gas-fired meat smoker devices, and gas barbecues. In addition, the principles and teachings set forth herein may find equal applicability to combustion burners for a variety of combustible fuels. The description below is therefore set forth only by way of illustration rather than limitation, and any intention to limit practice of the herein described methods and apparatus to any particular application is expressly disavowed.

Figure 1:
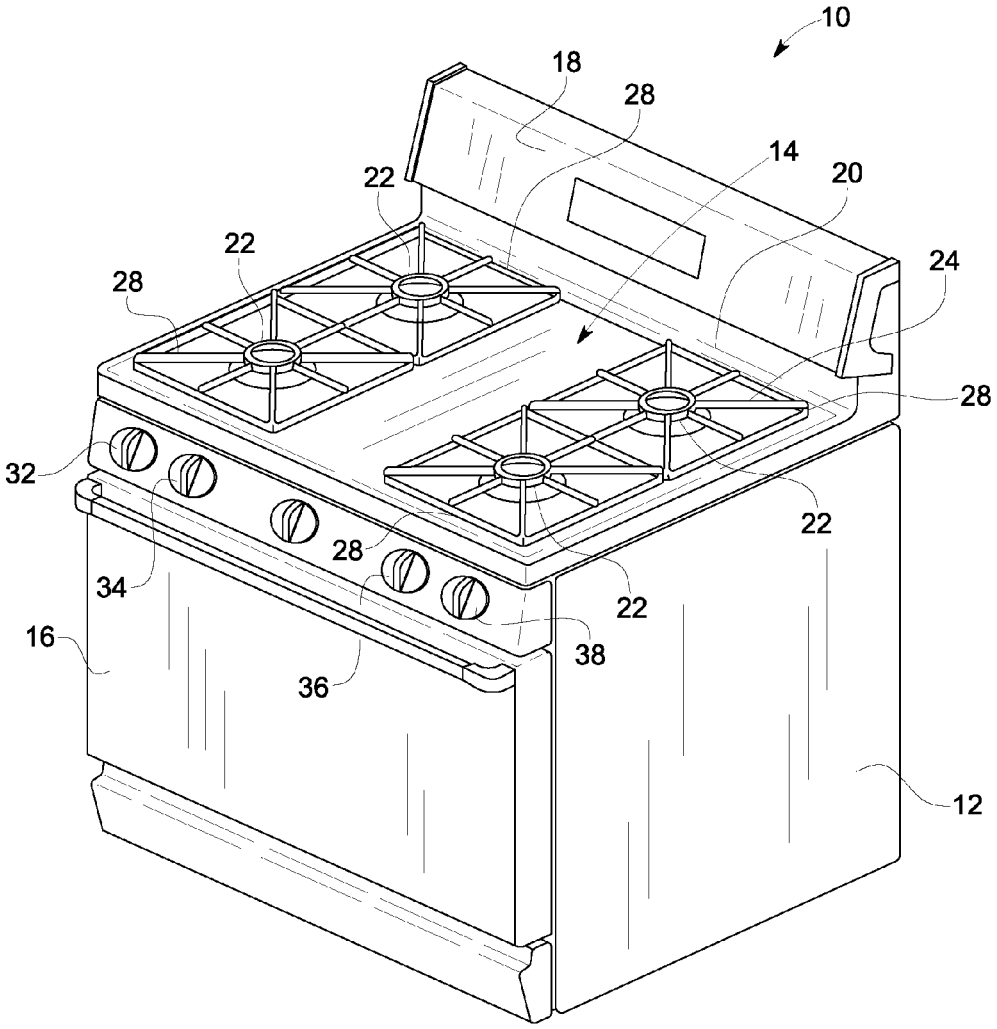
FIG. 1 PRIOR ART
FIG. 1 illustrates an embodiment of an exemplary freestanding gas range.

FIG. 1 illustrates an exemplary free-standing gas range 10 in which the herein described apparatus and methods may be practiced. Range 10 includes an outer body or cabinet 12 that incorporates a generally rectangular cooktop 14. An oven, not shown, is positioned below cooktop 14 and has a front-opening access door 16. A range backsplash 18 extends upward from a rear edge 20 of cooktop 14 and contains various control selectors (not shown) for selecting operative features of heating elements for cooktop 14 and the oven.

Cooktop 14 includes four gas fueled burner assemblies 22 which are positioned in spaced apart pairs positioned adjacent each side of cooktop 14. Each burner assembly 22 extends upward through an opening in cooktop 14, and a grate 28 is positioned over each burner assembly 22. Each grate 28 includes a horizontally extending support structure thereon for supporting cooking vessels.

Cooktop 14 also includes control devices, such as, knobs 32, 34, 36, and 38 that are manipulated by a user to adjust the setting of a corresponding gas valve (not shown) to control the amount of heat output from the corresponding one of burner assemblies 22. For example, rotating knob 32 in one direction switches the valve from off to the full on position. Continued rotation gradually moves the valve from the full open position to the minimum setting position. Accordingly, the user may adjust the heat output of the corresponding burner to the desired level.

It is contemplated that the herein described apparatus and methods are applicable, not only to cooktops which form the upper portion of a range, such as range 10, but to other forms of cooktops as well, such as, but not limited to, cooktops that are mounted to a kitchen counter. Therefore, range 10 is provided by way of illustration rather than limitation, and accordingly there is no intention to limit application of the herein described apparatus and methods to any particular appliance or cooktop, such as range 10 or cooktop 14. It is also to be understood that there can be any other number of burner assemblies or any combination of burner assemblies and other type of cooking surfaces, such as grills and hot plates, included in cooktop 14.

Figure 2:
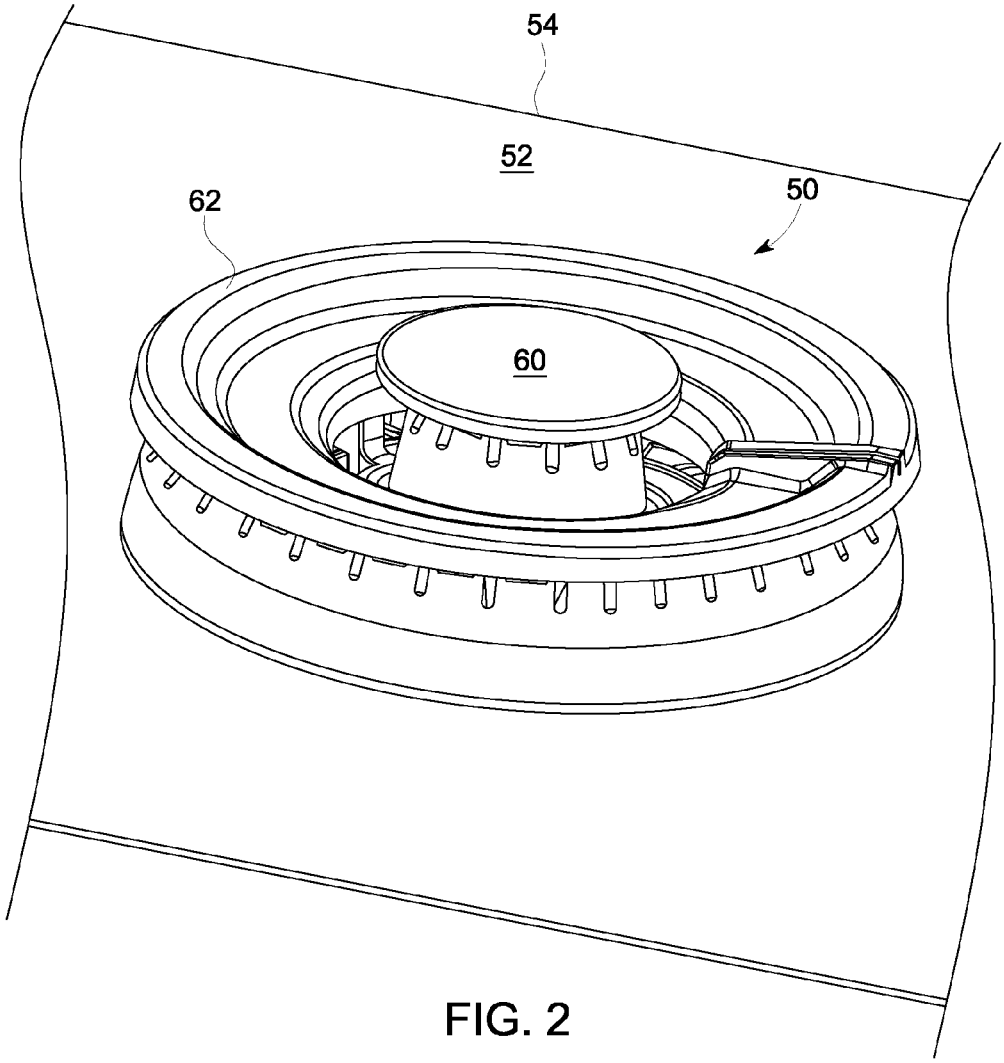
FIG. 2 is an exemplary burner assembly applicable to the gas range shown in FIG. 1.
Figure 3:
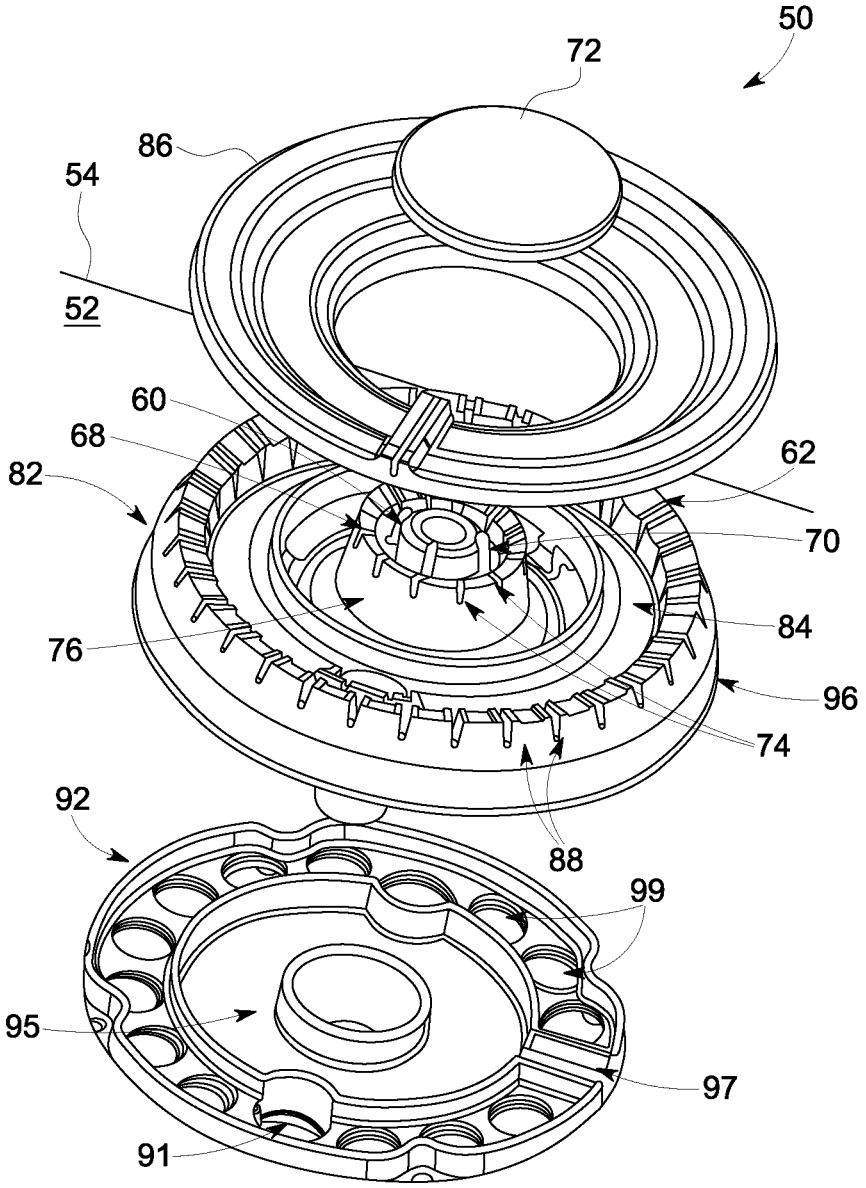
FIG. 3 is an exploded view of the burner assembly shown in FIG. 2.

FIG. 2 is an exemplary multi-ring burner assembly 50 applicable to gas range 10 shown in FIG. 1, and FIG. 3 is an exploded view of burner assembly 50 shown in FIG. 2. Burner assembly 50 is mounted on a cooktop surface 52 of a cooktop 54, and includes a central simmer burner 60, and an outer gas burner 62 concentric with simmer burner 60. In the exemplary embodiment, cooktop 54 is fabricated from one of steel and glass. Alternatively, cooktop 54 is made of other suitable materials.

As shown in FIG. 3, simmer burner 60 includes a simmer burner body 68 having a simmer burner chamber 70 defined therein, a central cap 72 for covering simmer burner body 68, and a plurality of ports 74 defined on an outer circumferential surface 76 of simmer burner body 68. Central cap 72 is substantially circular in shape, and is removably mounted on simmer burner body 68 for enclosing simmer burner chamber 70 therein. Removal of cap 72 also enables an operator to clean simmer burner chamber 70. Ports 74 are in flow communication with simmer burner chamber 70, and are shown in the form of slots in FIG. 3. In alternative embodiments, ports 74 have shapes other than slots.

Outer gas burner 62 is separate from simmer burner 60 and surrounds simmer burner 60 therein. Outer burner 62 includes an outer burner body 82 having a ring-shaped outer burner chamber 84 defined therein, a group of circumferentially spaced ports 88 defined thereon and an outer cap 86 for covering outer burner body 82.

Outer cap 86 is substantially ring-shaped, and is removably mounted on outer burner body 82 for enclosing outer burner chamber 84 therein. In alternative embodiments, outer cap 86 is other than ring shaped. Ports 88 are located on a circumferential surface 96 of outer burner body 82. Ports 88 are in flow communication with outer burner chamber 84, and are illustrated as slots in FIG. 3. However, in alternative embodiments, ports 88 have other shapes.

As shown in FIG. 3, burner assembly 50 also includes a base burner assembly 92. Base burner assembly 92 comprises a spill reservoir 95 and at least one radially extending channel 97. Spills exit the spill reservoir 95 through one or more channels 97. Assembly 92 further includes air openings 99 and venturi openings 91. Air openings 99 permit air from beneath the cooktop to enter the burner assembly. Venturi openings 91 receive the venturis (not shown in FIG. 3) feeding the outer gas burner 62. Spills that enter the area of the central simmer burner 60 are channeled between the air openings 99 and released through the perimeter of the main burner assembly 50 through channel 97 onto the top of the main cooktop surface 52 for easy cleaning as described in greater detail with reference to FIG. 6.

For a more detailed discussion of a multi-ring burner assembly, see, for example, United States Publication No. 2007/0154858, entitled "Gas Burner Assembly Including Inner and Outer Burners and Methods for Implementing Same," assigned to the assignee of the present invention and incorporated by reference herein.

Figure 4:
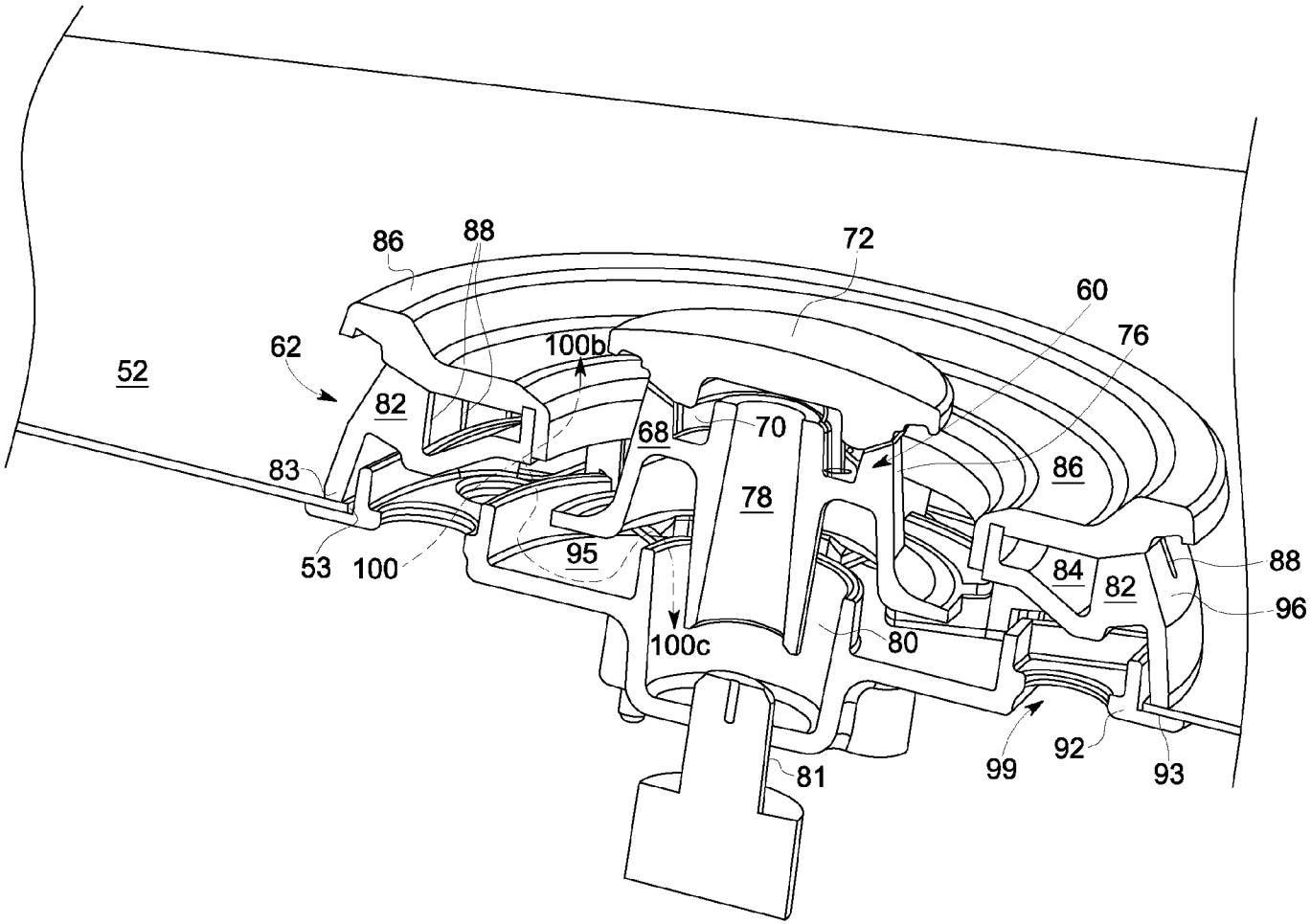
FIG. 4 is a cross sectional view of the burner assembly shown in FIGS. 2 and 3.

FIG. 4 is a cross sectional view of the burner assembly shown in FIGS. 2 and 3. In the exemplary embodiment, simmer burner body 68 and outer burner body 82 are mounted on cooktop 52. The burner assembly is received in a circular opening 53 in cooktop 52. A portion of the cooktop 52 surrounding opening 53 is positioned between an outer peripheral flange 93 of base assembly 92, and the lower edge 83 of outer burner body 82. As shown in FIG. 4, simmer burner body 68 includes a venturi 78 that is fed by a gas inlet 80 which receives gas from orifice 81.

As shown in FIG. 4, base burner assembly 92 includes one or more openings 99. In operation, simmer burner body 68 receives primary air and secondary air from an underside of cooktop surface 52 through opening 53. The air beneath cooktop surface 52 enters the burner assembly through openings 99 in burner base assembly 92 and flows through the annular gap between base burner assembly 92 and outer burner body 82 into the vicinity of the spill reservoir 95, where a portion of the air enters gas inlet area 80 (along path 100) to provide primary air to burner 60 and a portion follows path **100*b* to provide secondary air for burner 60. The primary air which enters inlet area 80 via path 100 mixes with gas supplied by orifice 81 to supply an air-gas mixture for inner burner 60 in a known manner. The air-gas mixture flows through venturi 78 to simmer burner chamber 70 and flows out from ports 74 defined on outer circumferential surface 76 of simmer burner body 68 (see FIG. 3). The air-gas mixture is ignited by an ignition source (not shown), such as a spark ignition electrode or a hot surface igniter, to generate an inner ring of flame (not shown) which is supported by the secondary air primarily comprised of the portion of air from openings 99 which follows path 100*b***.

Figure 6:
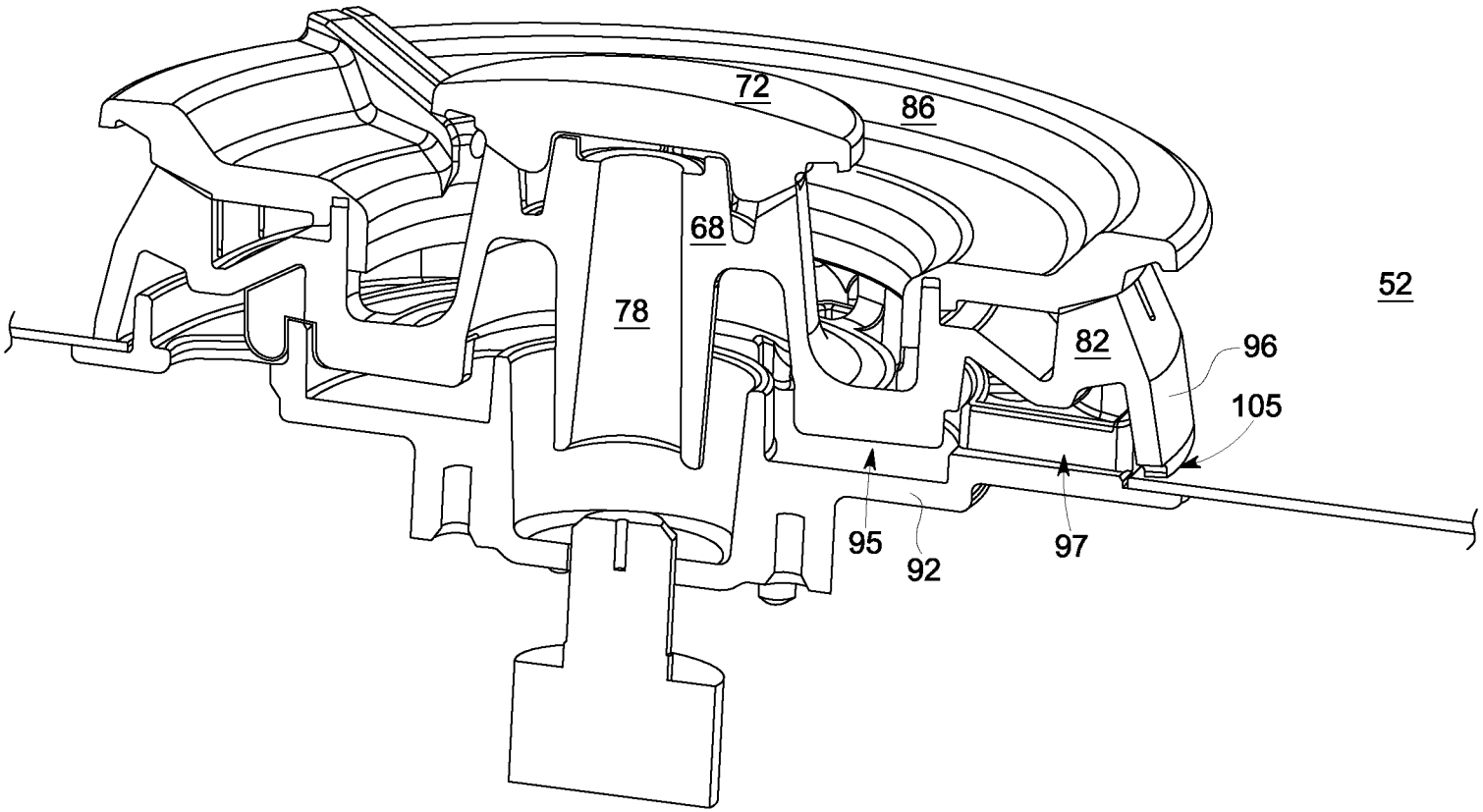
FIG. 6 is a cross sectional view of the burner assembly of FIGS. 2-4, illustrating a channel and an opening in accordance with the present invention.

Air-gas mixtures for outer burner 86 are supplied from beneath cooktop 52 through venturies 110 (see FIG. 6). This air-gas mixture flows out from ports 88, defined on circumferential surface 96 of outer burner body 82. The air-gas mixture exiting ports 88 is ignited to generate a ring of flame (not shown) and supported by secondary air from above the cooktop 52.

As shown in FIG. 4, the openings 99 are hidden from view by the outer burner body 82.

In this manner, the air path 100 brings in secondary air to the center simmer burner body 68 from beneath the cooktop 52, in addition to the primary air for burner body 68, through the openings 99 that are shielded from view by the outer burner body 82.

In this manner, a multi-ringed burner is provided that can be more easily cleaned, more aesthetically appealing, and provides a more compact design than existing design approaches. More specifically, the disclosed multi-ringed burner employs a sealed burner that directs the secondary air flow path to the center from beneath the cooktop through openings shielded from view by the main burner head and the spills are channeled around the openings to the exterior of the burner above the maintop.

Figure 5:
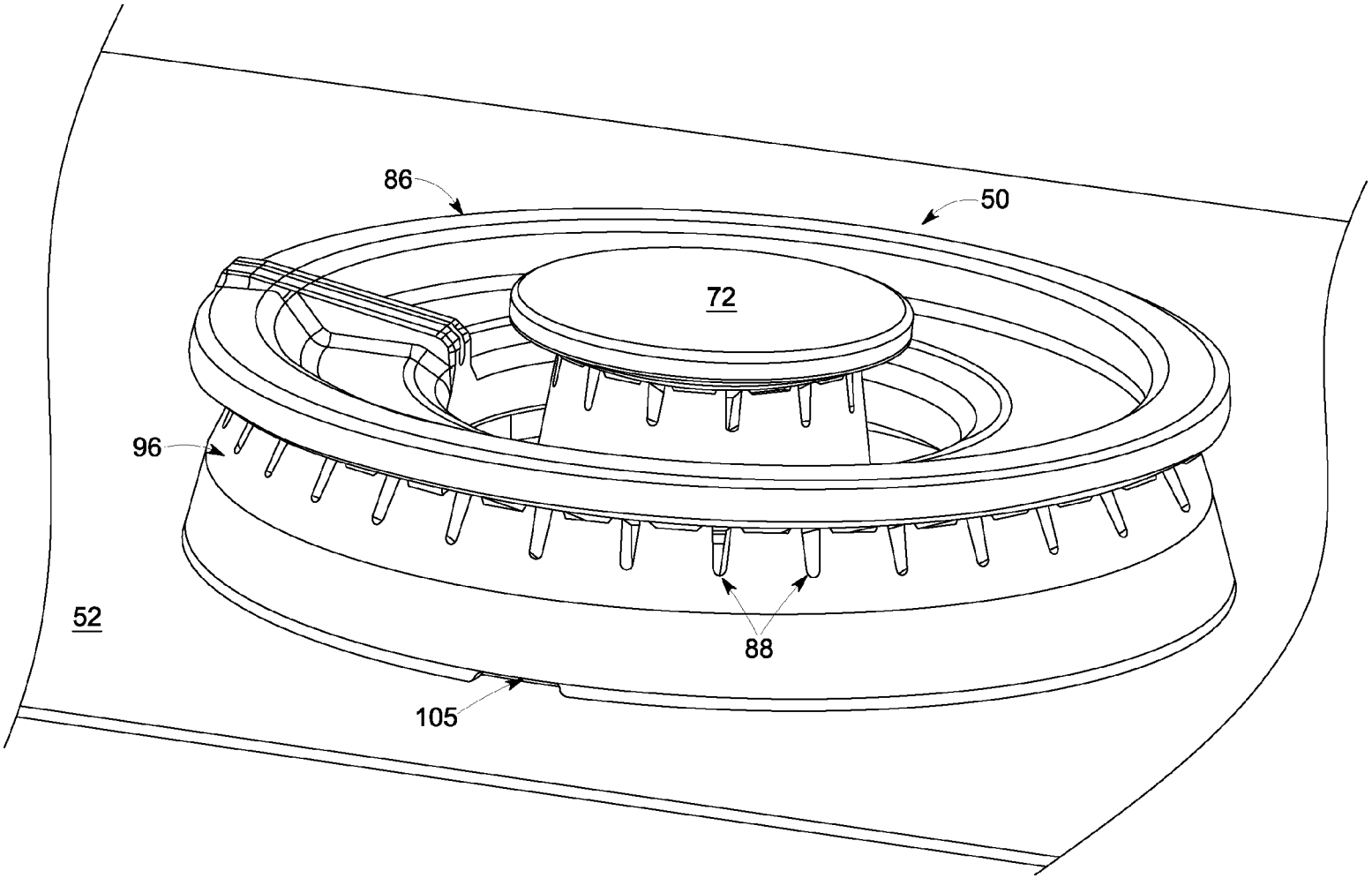
FIG. 5 is a side view of the burner assembly shown in FIGS. 2 through 4.

FIG. 5 is a side view and FIG. 6 is a cross sectional view of the burner assembly 50 shown in FIGS. 2 through 4. In the exemplary embodiment, simmer burner body 68, outer burner body 82 and base burner assembly 92 are mounted on cooktop 52. As shown in FIG. 5, burner assembly 50 provides a sealed appearance, with no appreciable or visible air gap. As discussed above in conjunction with FIG. 3, base burner assembly 92 comprises a spill reservoir 95 and at least one radially extending channel 97. Spills exit the spill reservoir 95 through one or more channels 97. The channels 97 of FIG. 3 are aligned with one or more openings 105 (FIG. 6). In this manner, spills are channeled through channel 97 onto the top of the main cooktop surface 52 for easy cleaning.

Figure 7:
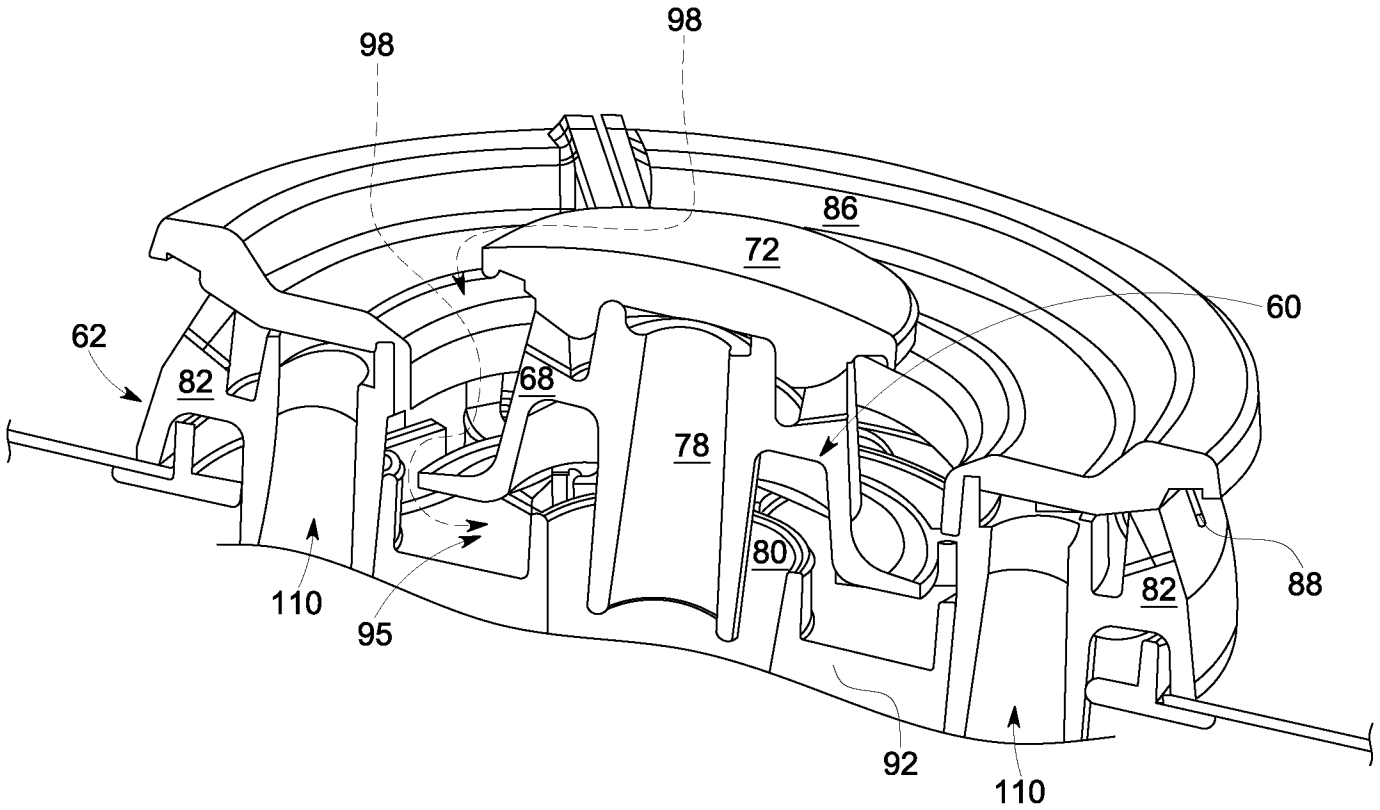
FIG. 7 is another cross sectional view of the burner assembly of FIGS. 2-4, illustrating a spill path in accordance with the present invention.

FIG. 7 is another cross sectional view of the burner assembly shown in FIGS. 2 through 4, illustrating spill path 98 through the burner assembly 50. As shown in FIG. 6, the spill path 98 is created between the simmer burner 60 and outer gas burner 62. Spills travel along spill path 98 into spill reservoir 95 (also shown in FIG. 3) and exit the reservoir 95 through channels 97 (FIG. 3) between air openings 99 and venturi openings 91 to the exterior of the burner assembly onto the main cooktop surface 52 for easy cleaning. As indicated above, the air-gas mixtures for outer burner 86 are supplied from beneath cooktop 52 through venturies 110. This air-gas mixture flows out from ports 88, defined on circumferential surface 96 of outer burner body 82.

Thus, while there have been shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A gas burner assembly for a cooking appliance including a cooktop surface, said gas burner assembly comprising:

an outer gas burner comprising an outer burner body, said outer gas burner configured to provide an outer cooking flame; and an inner gas burner comprising an inner burner body, said inner gas burner configured to provide an inner cooking flame, wherein air supplied to said inner gas burner flows through one or more openings in a base burner assembly through said cooktop surface other than a gas inlet for said inner gas burner, wherein one or more channels comprise a spill path beneath said outer gas burner onto said cooktop surface, wherein said base burner assembly and said outer burner body define an annular gap providing a flow path for said air from said one or more openings into said annular gap, and wherein said base burner assembly comprises a spill reservoir spaced apart from said inner burner body and shaped such that a first portion of said air flowing into said spill reservoir from said annular gap flows into said gas inlet and a second portion of said air flowing into said spill reservoir from said annular gap provides secondary air for said inner burner body.

2. The gas burner assembly of claim 1, wherein said one or more openings are substantially hidden from view by said outer gas burner.

3. The gas burner assembly of claim 1, wherein spills are channeled out of said gas burner assembly onto a top of said cooktop surface.

4. The gas burner assembly of claim 1, wherein a portion of said air flows through space between the base burner assembly and said outer burner body.

5. The gas burner assembly of claim 1, wherein a periphery of said gas burner assembly further comprises at least one opening aligned with said one or more channels and wherein said gas burner assembly is substantially sealed with said cooktop surface.

6. The gas burner assembly of claim 1, wherein said outer burner body and said inner burner body are substantially concentric.

7. A gas cooking appliance comprising:

a cooktop surface; and a gas burner assembly comprising:

an outer gas burner comprising an outer burner body, said outer gas burner configured to provide an outer cooking flame; and an inner gas burner comprising an inner burner body, said inner gas burner configured to provide an inner cooking flame, wherein air supplied to said inner gas burner flows through one or more openings in a base burner assembly through said cooktop surface other than a gas inlet for said inner gas burner, wherein one or more channels comprise a spill path beneath said outer gas burner onto said cooktop surface, wherein said base burner assembly and said outer burner hod define an annular gap providing a flow path for said air from said one or more openings into said annular gap, and wherein said base burner assembly comprises a spill reservoir spaced apart from said inner burner body and shaped such that a first portion of said air flowing into said spill reservoir from said annular gap flows into said gas inlet and a second portion of said air flowing into said spill reservoir from said annular gap provides secondary air for said inner burner body.

8. The gas cooking, appliance of claim 7, wherein said one or more openings are substantially hidden from view by said outer gas burner.

9. The gas cooking appliance of claim 7, wherein spills are channeled out of said gas burner assembly onto a top of said cooktop surface.

10. The gas cooking appliance of claim 7, wherein a periphery of said gas burner assembly further comprises at least one opening aligned with said one or more channels and wherein said gas burner assembly is substantially sealed with said cooktop surface.

11. The gas cooking appliance of claim 7, wherein said outer burner body and said inner burner body are substantially concentric.

* * * * *